US008505771B2

(12) United States Patent
Read

(10) Patent No.: US 8,505,771 B2
(45) Date of Patent: Aug. 13, 2013

(54) GOLF BALL DISPENSER

(76) Inventor: Tony Read, Mannings Heath (GB)

( * ) Notice: Subject to any disclaimer, the term of this patent is extended or adjusted under 35 U.S.C. 154(b) by 106 days.

(21) Appl. No.: 12/990,747

(22) PCT Filed: Apr. 24, 2009

(86) PCT No.: PCT/GB2009/001052

§ 371 (c)(1),
(2), (4) Date: Nov. 23, 2010

(87) PCT Pub. No.: WO2009/133347

PCT Pub. Date: Nov. 5, 2009

(65) Prior Publication Data

US 2011/0108566 A1 May 12, 2011

(30) Foreign Application Priority Data

May 2, 2008 (GB) ..... 0808071.5

(51) Int. Cl.
*A63B 47/00* (2006.01)
*B65D 83/04* (2006.01)

(52) U.S. Cl.
USPC ..... 221/260; 221/268

(58) Field of Classification Search
USPC ..... 221/65, 85, 208, 224, 247, 250, 251, 221/260, 267, 268, 276, 281, 289, 303, 307–310
See application file for complete search history.

(56) References Cited

U.S. PATENT DOCUMENTS

| | | | | |
|---|---|---|---|---|
| 1,418,093 | A | 5/1922 | Parmater | |
| 1,576,010 | A * | 3/1926 | Swartz | 221/281 |
| 2,708,053 | A * | 5/1955 | Berger et al. | 221/252 |
| 3,186,591 | A * | 6/1965 | Solomon | 221/260 |
| 3,206,067 | A * | 9/1965 | Smith, Jr. et al. | 221/281 |
| 3,471,056 | A * | 10/1969 | Kovac | 221/151 |
| 4,781,307 | A | 11/1988 | Ferro | |
| 5,040,675 | A | 8/1991 | Cleveland et al. | |
| 5,147,101 | A | 9/1992 | Tiller | |
| 5,667,082 | A * | 9/1997 | Hamilton et al. | 211/15 |
| 5,833,091 | A * | 11/1998 | Palmer | 221/256 |
| 6,419,600 | B1 * | 7/2002 | York et al. | 473/517 |
| 6,481,595 | B1 * | 11/2002 | Chilton | 221/185 |
| 7,549,557 | B2 * | 6/2009 | Lehmann | 221/251 |
| 2004/0004097 | A1 | 1/2004 | Seenauth | |
| 2007/0241128 | A1 * | 10/2007 | Smith | 221/281 |

FOREIGN PATENT DOCUMENTS

| | | |
|---|---|---|
| FR | 2 635 269 | 2/1990 |
| GB | 2 232 402 | 12/1990 |

* cited by examiner

*Primary Examiner* — Gene Crawford
*Assistant Examiner* — Kelvin L Randall, Jr.
(74) *Attorney, Agent, or Firm* — Diederiks & Whitelaw, PLC

(57) ABSTRACT

A golf ball dispenser is disclosed comprising a cavity for storing a plurality of golf balls. The dispenser comprises an exit opening through which the balls are dispensed and an ejection lever for ejecting a golf ball through the exit opening when activated. The dispenser and lever are configured so that as the lever is moved towards the exit opening so as to dispense a first ball the lever clamps the next ball to be dispensed within the dispenser so as to prevent the next ball from moving towards the exit opening.

11 Claims, 5 Drawing Sheets

GOLF BALL DISPENSER

CROSS-REFERENCE TO RELATED APPLICATIONS

This application represents a National Stage application of PCT/GB2009/001052 entitled "Gold Ball Dispenser" filed Apr. 24, 2009, pending.

BACKGROUND OF THE INVENTION

The present invention relates to a golf ball dispenser for both storing and dispensing golf balls.

Many different types of golf ball dispensers are known. However, there remains a need for a golf ball dispenser which is simple, reliable and convenient to use.

SUMMARY OF THE INVENTION

The present invention provides a golf ball dispenser having a cavity for storing a plurality of golf balls, the dispenser comprising an exit opening through which the balls are dispensed in use and an ejection lever for ejecting a golf ball through the exit opening when activated, wherein the dispenser and lever are configured so that as the lever is moved towards the exit opening so as to dispense a first ball the lever clamps the next ball to be dispensed within the dispenser so as to prevent the next ball from moving towards the exit opening.

As the lever serves to both eject a golf ball and clamp the next ball within the dispenser, golf balls can be dispensed one at a time in a simple and convenient manner and without subsequent balls to be dispensed jamming the ball ejection mechanism.

The dispenser comprises a housing defining a cavity for receiving and storing the plurality of golf balls and an exit opening in communication with the cavity for dispensing the balls. The housing preferably also defines a separate entrance opening through which golf balls may be inserted in order to re-fill the dispenser. In less preferred embodiments, the exit opening may function also as the entrance opening for re-filling the dispenser.

The dispenser housing preferably defines a substantially tubular cavity in which the balls may be stacked on top of each other. Preferably, the inner walls of the cavity are configured such that the balls are stacked one on top of the other in a single column of balls. Therefore, in the preferred embodiments, the housing defines a cavity which is substantially cylindrical. Other embodiments are contemplated wherein the inner walls of the cavity are provided with at least one projection for maintaining the balls stacked in a single column.

In the preferred embodiments, the exit opening is provided at one end of the tubular cavity. An entrance opening is preferably provided at the opposite end of the tubular cavity. The axis through the exit opening is preferably at an angle relative to the longitudinal axis through the tubular cavity. Most preferably, the two axes are substantially at right angles to each other.

The dispenser preferably comprises at least one retaining member adjacent to the exit opening for inhibiting movement of the golf balls through and out of the exit opening. This ensures that the golf balls must be forced out of the exit opening by the ejection lever and that they do not exit the dispenser accidentally. In the preferred embodiments the at least one retaining member extends part way across the exit opening. The at least one retaining member preferably comprises a projection which extends away from an inner wall of the dispenser into the cavity in a region adjacent to the exit opening. Preferably, the at least one projection provides a throat portion at the exit opening through which the ball must be forced. This throat portion preferably tapers inwardly to a most restrictive region and then preferably tapers outwardly to a less restrictive region in a direction from within the dispenser towards and out of the exit opening.

In the preferred embodiments, the at least one projection is moveable and resiliently biased into a position for inhibiting movement of the ball through and out of the exit opening. The dispenser and at least one projection are configured so that as the ball is forced towards the exit opening by the lever the ball automatically forces the projection out of the path of the ball so that the ball can pass through the exit opening.

In a particularly preferred set of embodiments the at least one projection is biased to a position spaced apart from an inner wall of the cavity so as to block the passage of the ball and is configured to be forced towards the inner wall by the ball as the lever is activated. In a particularly preferred set of embodiments the at least one retaining member extends from a rim of the exit opening into the dispenser to a distal free end that is spaced from the inner wall of the cavity. The projection is configured such that the distal free end may be forced towards the cavity wall by the ball so as to allow the ball to exit through the exit opening. In these embodiments, the at least one retaining member preferably extends substantially parallel to the inner wall of the cavity and spaced therefrom.

In other embodiments, the at least one retaining member may be a resilient material extending around the rim of the exit opening. For example, the retaining member may be a resilient polymer (e.g. rubber) lip extending part way or fully around the exit opening. The resilient material is arranged and configured to provide an exit opening diameter which is smaller than the maximum diameter of the golf ball. The resilient material is configured and/or has a consistency such that it is able to be forced out of the path of the ball as the ejection lever pushes the ball through the exit opening.

According to the preferred embodiments, at least two retaining members are provided which are spaced around the circumference of the exit opening. The retaining members are preferably spaced equidistantly around the exit opening.

As described above, the dispenser comprises an ejection lever for ejecting golf balls through the exit opening. The lever extends between a first end arranged inside of the dispenser cavity and a second end arranged outside of the cavity. The lever preferably extends through an aperture or slot in the housing so that the second end may be reached from outside of the housing. The first end of the lever is preferably maintained in a fixed position on an inner wall of the cavity. The first end of the lever is preferably fixed to the inner wall of the cavity that is opposite the exit opening. In the preferred embodiments the exit opening is in the front wall of the dispenser and the first end of the lever is attached to the back wall of the dispenser cavity.

The second end of the lever is moveable towards and away from the exit opening. The lever is configured such that as the second end of the lever is moved towards the exit opening a dispensing portion of the lever proximate the second end contacts and forces the lowermost ball in the stack of balls towards and out of the exit opening. Simultaneously, a clamping portion of the lever proximate the first end of the lever moves towards the adjacent ball in the stack until it clamps the adjacent ball within the dispenser so that it cannot move. The dispenser and lever are preferably configured such that the adjacent ball in the stack is clamped between the clamping portion of the lever and the front wall of the cavity. Other embodiments are contemplated wherein further balls in the stack are also clamped by the lever during dispensing of the lowermost ball.

For the avoidance of doubt, by the term lowermost ball in the stack it is meant the ball directly adjacent to the exit opening before the ejection lever is activated. The adjacent ball in the stack is the ball adjacent to the lowermost ball prior to activation of the ejection lever.

In the preferred embodiments, the lever is a single continuous member. The lever is preferably a bendable member. More preferably, the lever is resiliently biased away from the exit opening so that after the lowermost ball has been dispensed and the user releases the lever, the adjacent ball is automatically released from its clamped position. This allows the previously clamped ball to drop into a position adjacent the exit opening ready for being dispensed.

In the preferred embodiments the first end of the lever is fixedly adhered to or integral with the wall of the dispenser cavity. In less preferred embodiments the first end of the lever may be attached to the wall by a hinge mechanism.

According to the preferred embodiments, the surface of the lever that contacts the balls in use comprises a channel extending along the length of the lever from the first end towards the second end. This channel is configured to assist in maintaining the balls in a central position with respect to the width of the lever. The channel may be formed by a longitudinal recess extending along the length of the lever or the lever may be curved across its width.

In the preferred embodiments comprising an entrance opening that is separate to the exit opening, the entrance opening preferably also comprises at least one retaining member for preventing the golf balls from leaving the dispenser through the entrance opening. The at least one retaining member at the entrance opening may have any one or combination of the features described above in relation to the at least one retaining member associated with the exit opening.

In a particularly preferred set of embodiments the at least one retaining member at the entrance opening is a moveable member which is biased into a position which prevents balls from leaving through the entrance opening. In the preferred embodiments the at least one moveable member is pivotable and is biased so as to extend across at least a portion of the entrance opening. The movable member is preferably pivotable so as to allow golf balls to be pushed into the dispenser through the entrance opening and pushed passed the movable member. The movable member is preferably arranged and configured to be automatically moved by pushing a golf ball into the entrance opening so as to allow the ball to pass into the dispenser.

In the preferred embodiments, the retaining member is formed in a wall of the dispenser housing adjacent to the entrance opening. In these embodiments, the wall of the housing preferably comprises two slots which extend along the wall to the entrance opening and define the moveable member therebetween. The moveable member has a first end continuous with the wall of the housing and a second free end that is pivotable relative to the wall of the housing. Preferably, the moveable member is integral with the housing. In the preferred embodiments the moveable member is formed from a resilient material.

It will be appreciated that the at least one retaining member at the exit opening could comprise a pivotable member as described above in relation to the retaining member at the entrance opening. In these embodiments the ejection lever would act to force balls towards the exit opening so as to push the moveable member out of the path of the ball so that it is ejected through the exit opening.

According to the preferred embodiments the housing of the dispenser comprises an elongated tube configured to stack golf balls in a single column one on top of the other along its longitudinal axis. Preferably, the tubular housing is substantially cylindrical, although it may be other shapes in other embodiments.

In a preferred set of embodiments, the wall of the housing comprises a window for enabling a user to determine the number of balls stored in the dispenser. The window is preferably slot-shaped and extends part way between the exit opening and an entrance opening. The window is preferably an aperture in the wall of the housing. Alternatively, the window may be a transparent or translucent portion of the wall. Other embodiments are contemplated wherein the tubular portion of the dispenser is constructed entirely from transparent or translucent materials.

The dispenser preferably comprises a clip for attaching the dispenser to a belt, golf bag, golf cart or other apparatus. Preferably, the clip has a first end joined to the dispenser and a second free end which may be slid over a portion of the apparatus so as to trap the portion of the apparatus between the clip and the dispenser, thereby attaching the dispenser to the apparatus. Alternatively, in less preferred embodiments the dispenser may form an integral part of a golf cart or other apparatus.

From another aspect, the present invention provides a golf ball dispenser for storing a plurality of golf balls, the dispenser comprising an exit opening through which the balls are dispensed in use and an ejection lever for ejecting a golf ball through the exit opening when activated, wherein the dispenser and lever are configured so that as the lever is moved towards the exit opening so as to dispense a first ball the lever prevents the next ball from moving towards the exit opening.

The present invention also relates to a combination of a dispenser according to any one of the above described embodiments and a plurality of golf balls housed therein.

BRIEF DESCRIPTION OF THE DRAWINGS

An embodiment of the present invention will now be described, by way of example only, and with reference to the accompanying drawings, in which.

DETAILED DESCRIPTION OF THE INVENTION

Figure 1C:
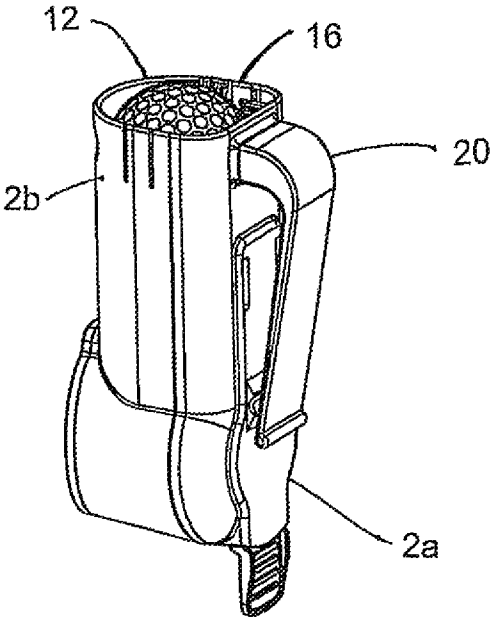
FIGS. 1A-1C show various views of a dispenser according to a preferred embodiment of the present invention.
Figure 1B:
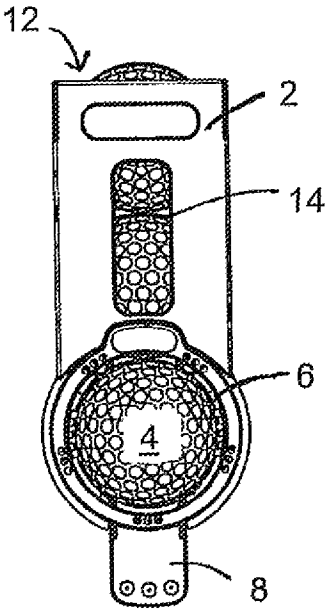
Figure 1A:
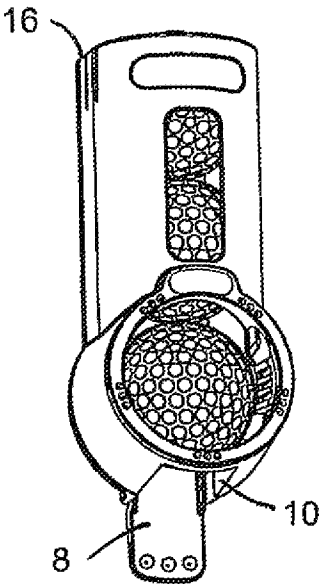

FIGS. 1A-1C show a preferred embodiment of the present invention. The preferred golf ball dispenser comprises a tubular housing 2 defining a cavity therein for storing a plurality of golf balls 4. The housing 2 comprises an exit opening 6 at the lower end of the front wall 2*b* and an ejection lever 8 which extends through a slot 10 in the bottom wall of the housing 2. The ejection lever 8 is used to selectively eject a ball 4 through the exit opening 6 and to clamp the next ball in the stack of balls within the housing 2, as will be described below with reference to FIGS. 4 and 5.

Figure 2:
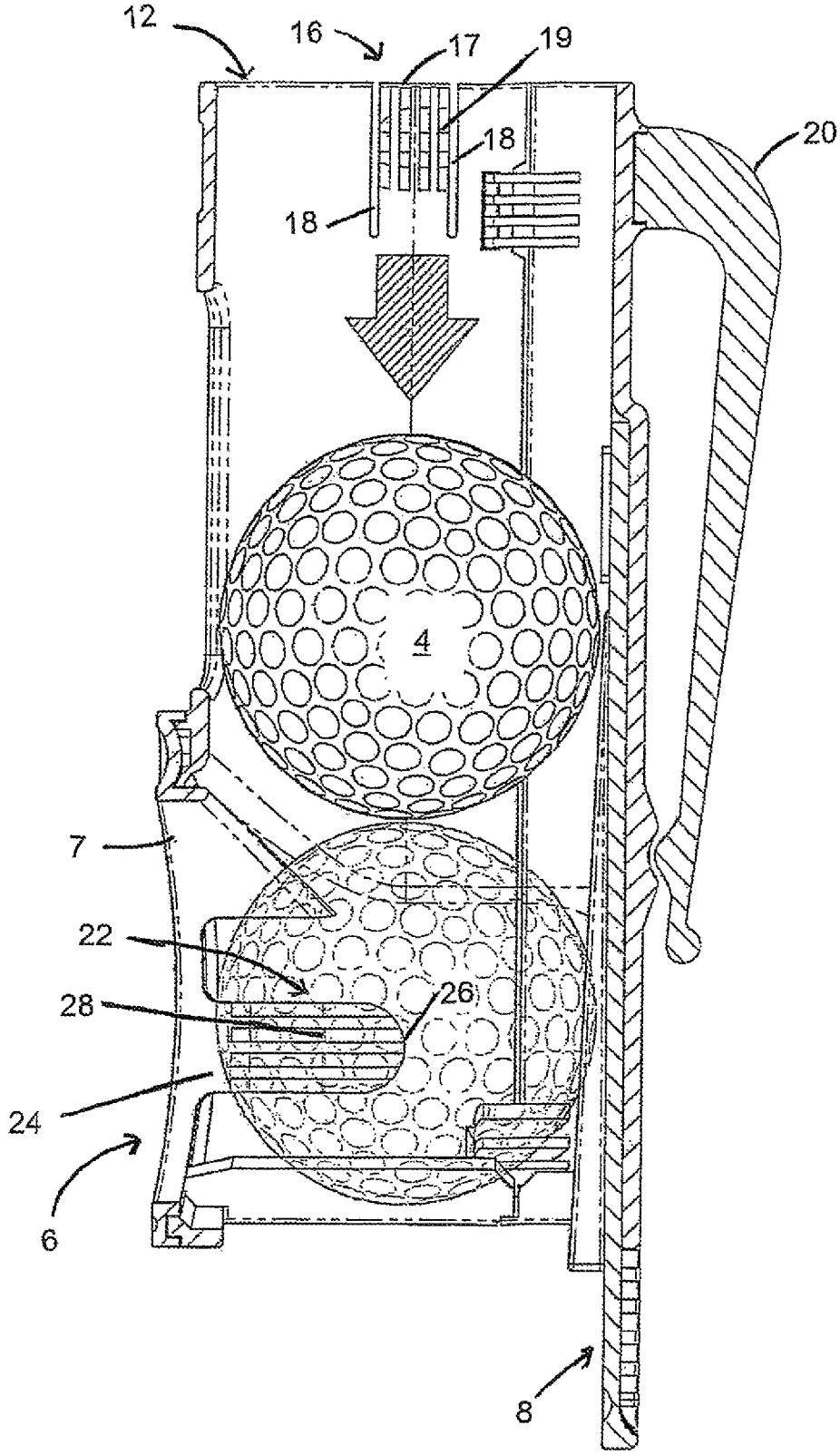
FIG. 2 shows a dispenser according to a preferred embodiment being loaded with golf balls.

The dispenser also comprises an entrance opening 12 in the top of the tubular housing 2 for filling the dispenser with golf balls 4. The balls 4 are prevented from leaving the dispenser through the exit opening 6 by retaining members (not shown) adjacent to the exit opening 6, which will be described further below. As such, the balls 4 stack up one on top of the other within the tubular housing 2. The tubular housing 2 comprises a window 14 which allows the user to determine how many balls 4 are stored within the dispenser. Retaining members 16 are also located at the entrance opening 12 of the dispenser which allow the balls 4 to passed through the entrance opening 12 and into the tubular housing 2, but which prevent the balls 4 from leaving the housing 2 through the entrance opening 12. As best shown in FIG. 2, the retaining members 16 at the entrance opening 12 each include a pivotable member 17 which is formed between two parallel slots 18 in the side wall of the housing 2. Each retaining member 16 has a free end comprising a projection 19 which extends in a direction from the side wall of the housing part way towards the opposite side wall. This projection 19 is arranged and configured such that balls 4 are prevented from exiting the housing through the entrance opening 12, for example, if the dispenser is dropped. More specifically, the maximum diameter of a golf ball 4 is larger than the gap between the distal ends of the projections 19 on the opposing retaining members 16.

The pivotable members 17 are flexible and enable golf balls 4 to be forced into the dispenser through the entrance opening 12 in order to refill the dispenser. When a golf ball 4 is inserted into the entrance opening 12 a portion of the golf ball 4 meets the projections 19. As the golf ball 4 is continued to be pushed into the housing the side of the ball 4 forces the pivotable members 17 to flex outwardly such that the ball 4 can pass the projections 19. The pivotable members 17 are formed from a resilient material and automatically flex back to their original position once the ball 4 has been forced past them and into the dispenser. This prevents the balls 4 from passing back out of the dispenser through the entrance opening 12.

The dispenser also comprises a clip 20 for attaching it to a bag, belt or other apparatus.

FIGS. 2-5 show cross-sectional views through the dispenser at various stages during filling of the dispenser with golf balls 4 and dispensing a golf ball 4.

FIG. 2 shows a view of the dispenser after a single golf ball 4 has been inserted into the entrance opening 12 and past the entrance opening retaining members 16. As the dispenser is for use with the tubular housing arranged vertically the ball 4 drops to the position adjacent the exit opening 6 and which is shown in phantom. As mentioned previously, the balls 4 are inhibited from passing through the exit opening 6 by retaining members 22 located adjacent to the exit opening 6. Each retaining member 22 has a first end 24 extending from a rim 7 of the exit opening 6 towards a second, free distal end 26. The retaining member 22 has a first major surface which faces away from the golf ball 4 and which extends parallel to and spaced apart from the adjacent wall of the cavity. The retaining member 22 has a second major surface opposite to the first major surface and which contacts the lowermost golf ball 4 to inhibit its movement out of the exit opening 6. The second major surface of the retaining member comprises a projection 28 which extends away from the cavity wall into the cavity. The projection 28 tapers inwardly into the cavity from the second end 26 of the retaining member 22 towards the exit opening 6 to form a restrictive throat which blocks the passage of the lowermost ball 4 towards the exit opening 6. The projection 22 then tapers outwardly to a less restrictive portion between the throat and the rim 7. Although only one retaining member 22 is shown, another retaining member is provided on the opposing side of the cavity.

The retaining members 22 are resiliently biased such that the projections 28 prevent the lowermost ball 4 from passing towards the exit aperture 6. However, the free, distal ends 26 of the retaining members 22 are configured to flex outwardly towards the cavity walls when the lever 8 is activated so as to allow the ball 4 to be dispensed, as will be described below.

Figure 3:
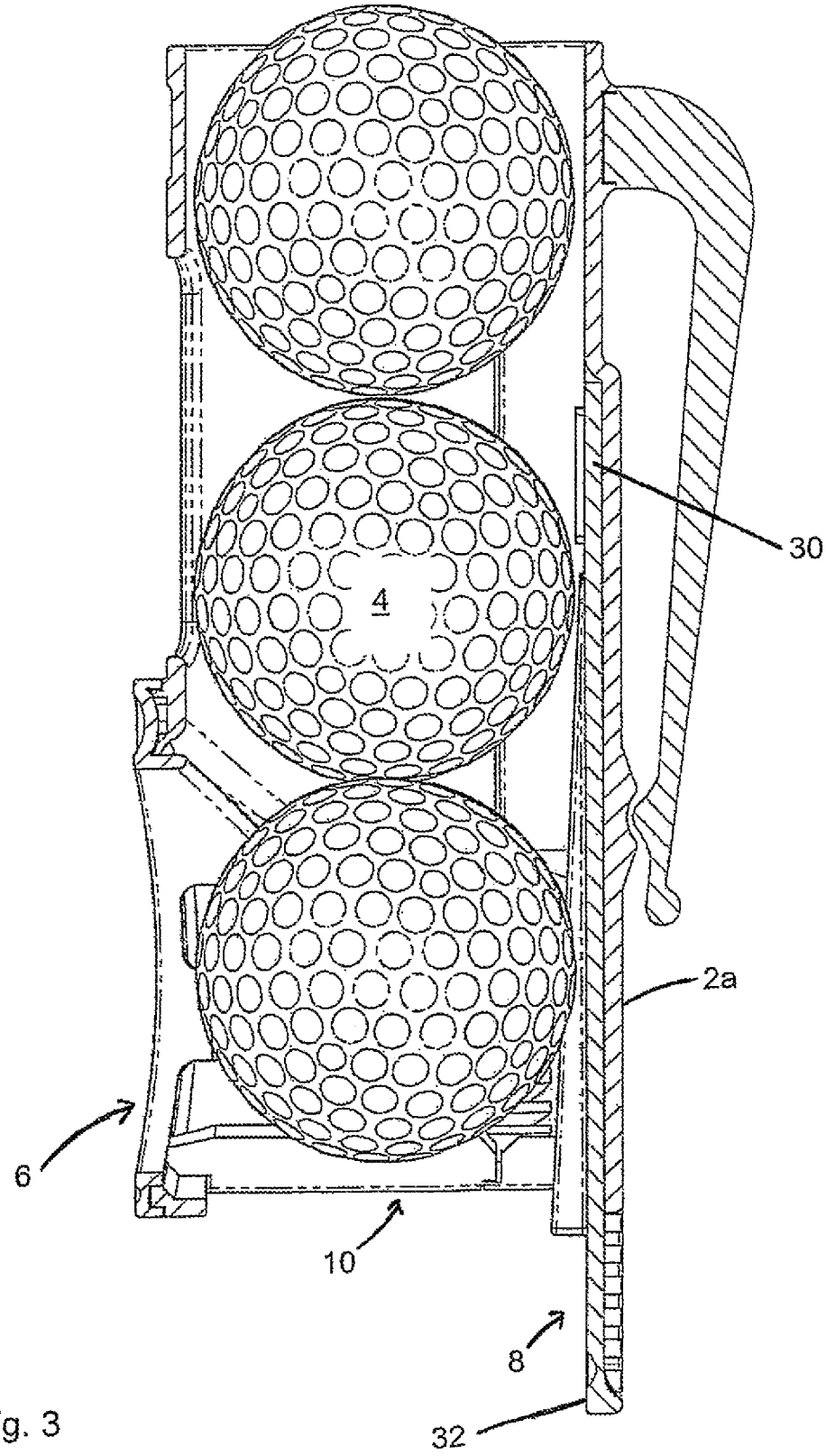
FIG. 3 shows the dispenser of FIG. 2 fully loaded with golf balls.

FIG. 3 shows a view of the dispenser after a plurality of golf balls 4 have been inserted.

When it is desired to dispense a golf ball 4 from the exit opening 6 the ejection lever 8 must be activated. The lever 8 is made from a flexible, resilient material and extends from a first end 30 attached to the inside surface of the housing back wall 2*a* to a second, free end 32. The lever 8 extends through a slot 10 in the bottom wall of the dispenser so that the second free end 32 of the lever 8 may be accessed from outside of the dispenser. The slot 10 in the bottom wall of the dispenser extends between the back wall 2*a* and the exit opening 6 and acts to guide the ejection lever 10.

In order to dispense a golf ball 4 from the dispenser the second, free end 32 of the lever 8 is pulled forward towards the exit opening 6.

Figure 4:
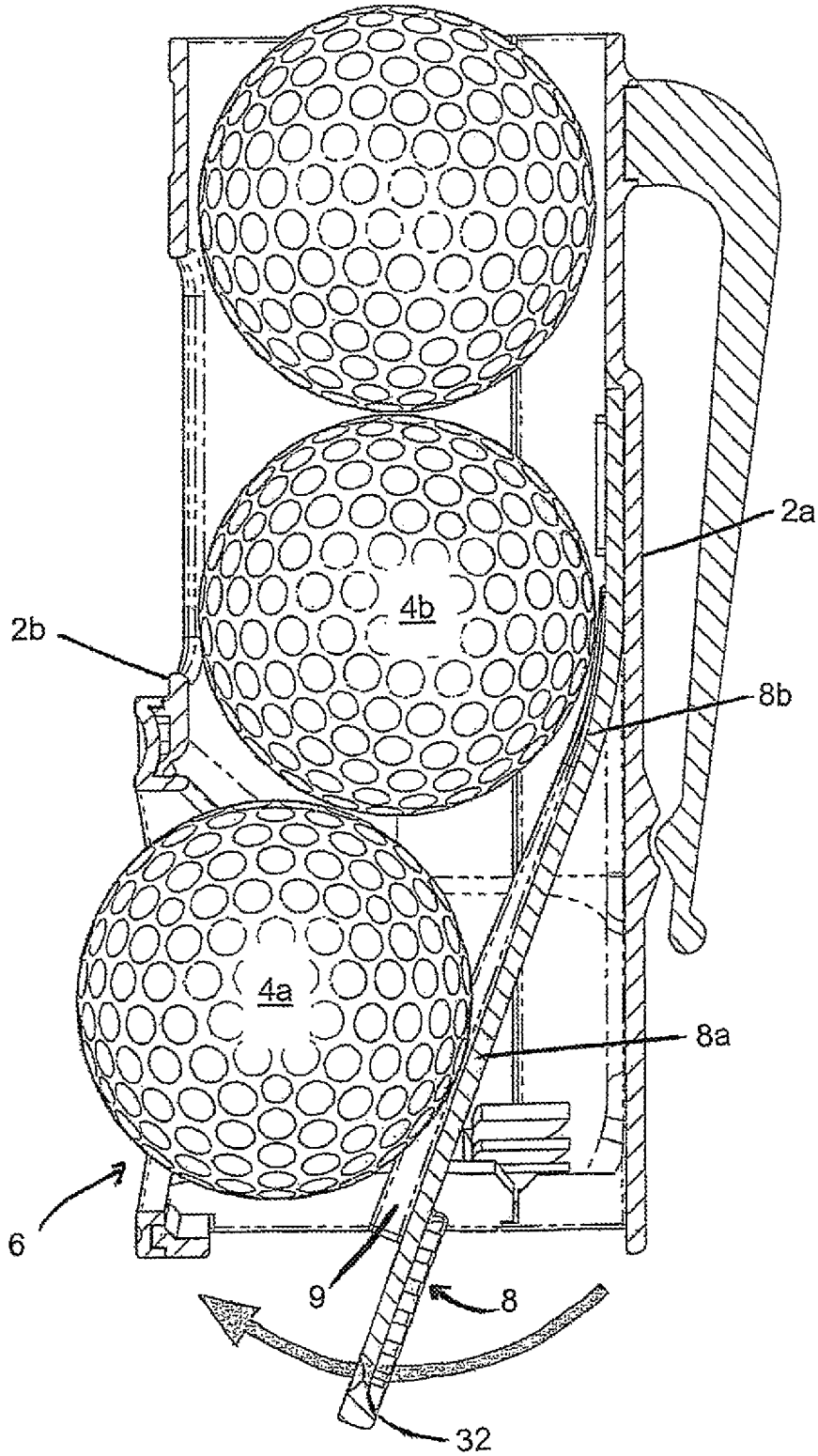
FIG. 4 shows the dispenser of FIG. 2 whilst the lowermost ball is being dispensed.

FIG. 4 shows a cross-sectional view of the dispenser when the second, free end 32 of the lever 8 has been pulled part way towards the exit opening 6. As can be seen from FIG. 4, the lever 8 flexes and the lower, dispensing portion 8*a* of the lever 8 contacts and forces the lowermost golf ball 4*a* towards the exit opening 6. As the retaining members 22 at the exit opening 6 taper outwardly between the restrictive throat 28 and their free distal ends 26 (see FIG. 2) the passage of the ball 4 towards the exit opening 6 forces the retaining members 22 outwardly until the lowermost ball 4 passes the restrictive throat 28 and exits through the exit opening 6. The resiliently biased retaining members 22 then flex back to their original position to inhibit the next ball 4*b* from exiting through the exit opening 6.

As the ejection lever 8 flexes towards the exit opening 6, the upper clamping portion 8*b* of the lever 8 also travels towards the second ball 4*b* in the stack of balls until it contacts the second ball 4*b* and forces it against the front wall 2*b* of the dispenser. The ejection lever 8 comprises a channel 9 extending between the first and second ends 30,32 of the lever 8. The channel 9 is profiled so as to cup the golf balls 4*a*,4*b* and to maintain the centres of the balls 4*a*,4*b* aligned with the centre of the width of the lever 8. The lever 8 is continued to be moved towards the exit opening 6 until the lowermost ball 4*a* is dispensed.

Figure 5:
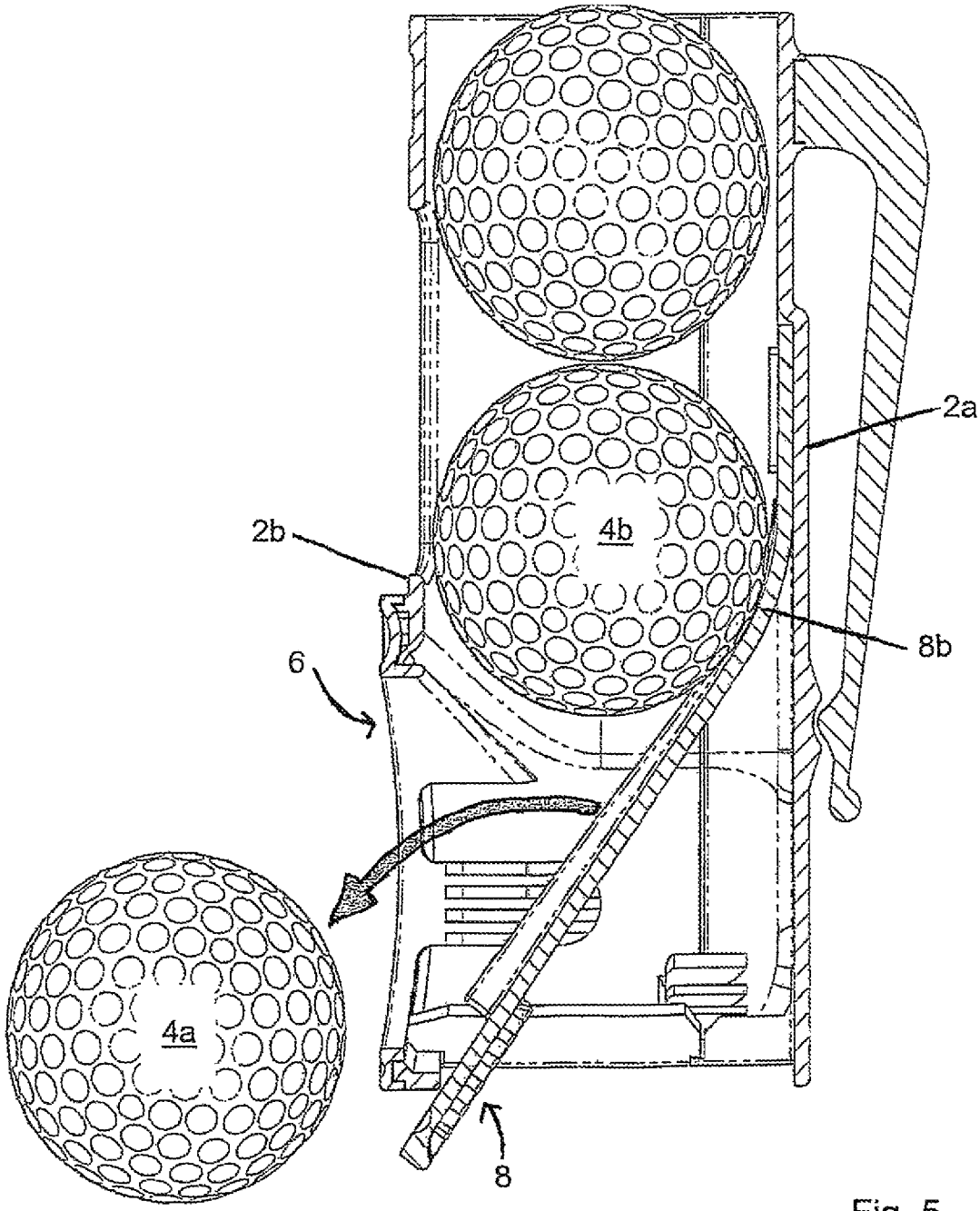
FIG. 5 shows the dispenser of FIG. 2 immediately after the lowermost ball has been dispensed.

FIG. 5 shows a view of the dispenser at the time when the lever 8 has been brought fully towards the exit opening 6 and when the lowermost ball 4*a* has just been dispensed. It can be seen from this that the second ball 4*b* is clamped within the dispenser between the upper clamping portion 8*b* of the lever 8 and the front wall 2*b* of the cavity. This enables simple and reliable dispensing of the lowermost ball 4*a* without the second ball 4*b* in the stack interfering with and jamming the dispensing mechanism. The present invention also prevents multiple balls 4 from being dispensed at the same time.

The lever 8 is resiliently biased so that when it is released it will automatically return towards the back wall 2*a*. As such, the second ball 4*b* will no longer be clamped within the dispenser and therefore the remaining balls 4 within the dispenser will fall towards the bottom of the dispenser, resulting in a configuration as shown in FIG. 2 with balls 4 located as shown by both the solid and phantom lines. The dispensing process may then be repeated again to dispense the ball 4*b* adjacent to the exit opening 6. This may be repeated until the dispenser no longer contains any balls 4.

The invention claimed is:

1. A golf ball dispenser having a cavity configured to store a plurality of golf balls, said dispenser comprising an exit opening through which the balls are dispensed in use and a flexible ejection lever configured to eject a golf ball through the exit opening when activated, wherein the dispenser and lever are configured so that as the lever is moved towards the exit opening so as to dispense a first ball and, after dispensing the first ball, the lever bends around and contacts one side of a next ball to be dispensed and forces an opposite side of the next ball against a wall of the cavity so as to clamp the next ball, without the first ball below the next ball, within the dispenser so as to prevent the next ball from moving towards the exit opening, wherein the lever extends between a first end arranged in a fixed position inside of the dispenser cavity and a second moveable end arranged outside of the cavity.

2. A golf ball dispenser as claimed in claim 1, wherein the lever is arranged and configured such that as the second end of the lever is moved towards the exit opening a dispensing portion of the lever contacts and forces said first ball out of the exit opening and a clamping portion of the lever simultaneously moves towards said next ball until the clamping portion clamps the next ball within the dispenser.

3. A golf ball dispenser as claimed in claim 2, wherein the clamping portion of the lever is proximate the first end of the lever and the dispensing portion of the lever is proximate the second end of the lever.

4. A golf ball dispenser as claimed in claim 2, wherein said next ball is clamped between the clamping portion of the lever and an inner wall of the cavity in use.

5. A golf ball dispenser as claimed in claim 1 wherein the second movable end is arranged below the cavity.

6. A golf ball dispenser having a cavity configured to store a plurality of golf balls, said dispenser comprising an exit opening through which the balls are dispensed in use and an ejection lever configured to eject a golf ball through the exit opening when activated, wherein the dispenser and lever are configured so that as the lever is moved towards the exit opening so as to dispense a first ball and, after dispensing the first ball, the lever clamps a next ball to be dispensed, without the first ball below the next ball, within the dispenser so as to prevent the next ball from moving towards the exit opening, wherein the lever is a flexible member configured to bend around the next ball when clamping the next ball.

7. A golf ball dispenser having a cavity configured to store a plurality of golf balls, said dispenser comprising an exit opening through which the balls are dispensed in use and a flexible ejection lever configured to eject a golf ball through the exit opening when activated, wherein the dispenser and lever are configured so that as the lever is moved towards the exit opening so as to dispense a first ball and, after dispensing the first ball, the lever bends around and clamps the next ball to be dispensed, without the first ball below the next ball, within the dispenser so as to prevent the next ball from moving towards the exit opening, said golf ball dispenser further comprising at least one retaining member adjacent to the exit opening for inhibiting movement of a golf ball through and out of the exit opening.

8. A golf ball dispenser as claimed in claim 7, wherein the retaining member comprises a movable projection which is resiliently biased into a position for inhibiting movement of the ball through and out of the exit opening.

9. A golf ball dispenser as claimed in claim 7, wherein the dispenser and at least one retaining member are configured so that the retaining member is automatically forced out of the path of the first ball as the first ball is forced towards the exit opening by the lever.

10. An apparatus comprising:

a plurality of golf balls including a first ball to be dispensed and a next ball to be dispensed; and a golf ball dispenser including a housing formed with a wall bordering a cavity configured to store the plurality of golf balls, said dispenser comprising an exit opening through which the plurality of balls are dispensed in use and a flexible ejection lever configured to eject the first ball through the exit opening when activated, wherein the dispenser and lever are configured so that as the lever is moved towards the exit opening so as to dispense the first ball and, after dispensing the first ball, the lever bends around and contacts one side of the next ball and forces an opposite side of the next ball against the wall so as to clamp the next ball, without the first ball below the next ball, within the dispenser so as to prevent the next ball from moving towards the exit opening, wherein the lever extends between a first end arranged in a fixed position inside of the dispenser cavity and a second moveable end arranged outside of the cavity.

11. An apparatus comprising:

a plurality of golf balls including a first ball to be dispensed and a next ball to be dispensed; and a golf ball dispenser having a cavity configured to store the plurality of golf balls, said dispenser comprising an exit opening through which the balls are dispensed in use and an ejection lever configured to eject the first ball through the exit opening when activated, wherein the dispenser and lever are configured so that as the lever is moved towards the exit opening so as to dispense the first ball and, after dispensing the first ball, the lever clamps the next ball, without the first ball below the next ball, within the dispenser so as to prevent the next ball from moving towards the exit opening, wherein the lever is a flexible member configured to bend around the next ball when clamping the next ball.

* * * * *